US007162838B2

(12) United States Patent
Ardern

(10) Patent No.: US 7,162,838 B2
(45) Date of Patent: Jan. 16, 2007

(54) CONSTRUCTION PANELS

(76) Inventor: Fergus Jonathan Ardern, Eastwood, Folgate Lane, Old Costessey, Norwich, Norfolk (GB) NR8 5EF ( * ) Notice: Subject to any disclaimer, the term of this patent is extended or adjusted under 35 U.S.C. 154(b) by 371 days.

(21) Appl. No.: 10/737,438

(22) Filed: Dec. 16, 2003

(65) Prior Publication Data

US 2005/0072094 A1 Apr. 7, 2005

(30) Foreign Application Priority Data

Oct. 4, 2003 (GB) ..... 0323314.5

(51) Int. Cl.
*E01C 9/08* (2006.01)

(52) U.S. Cl. ..... 52/127.9; 52/177; 52/392; 52/574; 52/582.2; 52/592.1; 52/747.11; 404/41

(58) Field of Classification Search ..... 52/127.7, 52/127.8, 127.9, 127.11, 177, 592.1, 582.2, 52/587, 747.11, 285.1, 574, 575, 391, 392; D25/113, 138; 404/41
See application file for complete search history.

(56) References Cited

U.S. PATENT DOCUMENTS

| | | | | |
|---|---|---|---|---|
| 991,896 | A * | 5/1911 | Sajo | 52/575 |
| 2,019,692 | A * | 11/1935 | Mueller | 160/229.1 |
| 2,834,065 | A * | 5/1958 | Mueller | 52/506.1 |
| 3,500,606 | A | 3/1970 | Wharmby | 52/589 |
| 4,289,818 | A | 9/1981 | Casamayor | 428/43 |
| 4,373,306 | A | 2/1983 | Rech | 52/98 |
| 4,641,988 | A * | 2/1987 | Ganner | 403/245 |
| 5,046,887 | A * | 9/1991 | Fontana et al. | 404/34 |
| 5,222,342 | A * | 6/1993 | Defferrari | 405/284 |
| 5,836,125 | A | 11/1998 | Regina | 52/306 |
| 6,089,784 | A | 7/2000 | Ardern | 404/41 |
| D465,857 | S | 11/2002 | Ardern | D25/138 |

FOREIGN PATENT DOCUMENTS

| | | |
|---|---|---|
| CH | 540 398 | 9/1973 |
| DE | 1 509 841 | 6/1969 |
| DE | 85 20 182 | 11/1986 |

(Continued)

OTHER PUBLICATIONS

U.S. Design Application, filed Apr. 14, 2004, entitled Constructional or Ground Covering Panel (Ardern) (application number not yet assigned).

*Primary Examiner*—Robert Canfield
(74) *Attorney, Agent, or Firm*—Synnestvedt & Lechner LLP

(57) ABSTRACT

A constructional panel has a generally rectangular central section and two opposed end sections, each having an isosceles trapezoid part, its short edge conjoined to an edge of the central section and its long edge conjoined to a rectangular part, there being oblique edges extending between the long and short edges. The panel is thus bound by one pair of opposed edges of the central section, the oblique edges of the two end sections, one pair of opposed edges of the rectangular part and a further edge of the rectangular part opposed to that edge conjoined to the trapezoid part. The panel edges are configured for connection to the corresponding edges of like panels to build up an area of panelling. Projecting tabs from some edges are received in corresponding receptors on opposed edges and having lock arrangements, whereby the interengaged panels may be locked together.

22 Claims, 4 Drawing Sheets

FOREIGN PATENT DOCUMENTS

| | | | |
|---|---|---|---|
| DE | 86 32 856 | | 3/1987 |
| DE | 94 21 260 | | 9/1995 |
| EP | 0 013 896 | | 8/1980 |
| EP | 0 176 645 | | 4/1986 |
| EP | 0 286 395 | | 10/1988 |
| FR | 2 240 320 | | 3/1975 |
| FR | 2 536 150 | | 5/1984 |
| FR | 2 559 177 | | 8/1985 |
| FR | 2 733 282 | | 10/1996 |
| GB | 320 657 | | 10/1929 |
| GB | 1 212 983 | | 11/1970 |
| GB | 1 445 617 | | 8/1976 |
| GB | 2 101 174 | | 1/1983 |
| JP | 4-110326 | | 4/1992 |
| WO | WO 91/13208 | | 9/1991 |
| WO | WO 97/18353 | | 5/1997 |
| WO | 2005/035874 | * | 4/2005 |

* cited by examiner

CONSTRUCTION PANELS

BACKGROUND OF THE INVENTION

1. Field of the Invention

This invention relates to a constructional panel and in particular to such a panel which may be built up into a generally planar array of individual like panels, interconnected by their adjacent edges. The invention further relates to a method of building up a substantially planar array of a plurality of individual panels each of which also is of this invention.

In this specification, the term "constructional panel" is used to refer to a generally planar panel the thickness of which is much smaller than the dimensions of the panel in its plane, and which may be used in the construction of one or more of a decorative, cladding, load-bearing or structural array of such panels. For example, the panel may be used with other like panels in constructing a temporary, semi-permanent or even essentially permanent area of flooring, ground-decking or hard-standing, or a pathway, track or runway. The panel may instead be used in constructing cladding or panelling for a frame-work to form a space divider, screen or wall, or structurally directly to provide a wall. The invention is not to be regarded as limited to these various uses, and may be used in many circumstances where an array of interconnected individual panels fulfils a demand.

A principal use of the constructional panels of this invention is to provide temporary ground decking, though in fact the panels may be used for a variety of other purposes as mentioned above. However, though the invention is not to be regarded as limited to the use of ground decking of various kinds, including temporary paths, trackways or runways, it will primarily be described hereinafter with reference to that use.

2. Description of the Related Art

It is known to build up a relatively large-scale array of panels suitable for use, for example, as ground decking, by interconnecting a plurality of individual like panels. For instance, in my own earlier International Patent Publication No. WO 97/18353, I have described and claimed a generally rectangular panel provided with interconnecting mechanisms on its four edges, to permit the connection of the panel to four other panels arranged one alongside each of the four edges of the first panel. In this way, a relatively large-scale essentially planar structure may be built, suitable for use as temporary decking for soft ground, hard standing for aircraft, a temporary trackway over ground, or even suitable for use as a temporary runway for aircraft, amongst many other possible uses. Equally, however, the panels may be relatively small such that the array of interconnected panels may be used to floor a relatively small area, such as of a marquee erected on grass. Other examples of panels suitable for interconnection to form an extensive array may also be found in U.S. Pat. Nos. 3,500,606, 4,373,306 and International Patent Specification No. WO 91/13208. In each case, the described panel is of rectangular shape, and is interconnected to four adjacent panels by an arrangement provided on the respective edges of the panels.

A disadvantage of the arrays of panels described in all of the above documents is that the panels are disposed in a rectangular grid arrangement, with straight lines between the rows and columns of panels. Almost inevitably, the interconnections between the panels are weaker than the panels themselves and so there are lines of weakness extending linearly both transversely and along the length of the array, at regularly spaced intervals. In the case of my own earlier design described in WO 97/18353, this has the advantage that a number of the connected panels may be rolled up for transport or storage, but the long straight lines of interconnection do still reduce the rigidity and strength of the array of connected panels.

SUMMARY OF THE INVENTION

It is a principal aim of the present invention to provide a panel suitable for building up into an array of like panels, wherein the panels are interconnected at their adjacent edges, and yet there are no linear lines of weakness extending across the built-up array, in any direction.

Accordingly, one aspect of this invention provides a constructional panel comprising a central section and two opposed end sections. The central section is of generally rectangular form with two parallel external side edges and two parallel end edges. Each end section has an isosceles trapezoid part conjoined to a rectangular part, the trapezoid part having parallel long and short edges and a pair of external oblique edges, and the rectangular part having a pair of parallel first edges and a pair of external second edges. The short edge of the trapezoid part conjoins an end edge of the central section and the long edge of the trapezoid part conjoins a first edge of the rectangular part, the other first edge of the rectangular part being external. The length of the external side edges of the central part are substantially twice the length of the each second edge of the rectangular parts. Such a panel may be interengaged with other like panels by engaging an oblique edge of an end section of one panel with an oblique edge of an end section of a second panel, a second edge of the rectangular part of the interengaged end sections of each of the two panels engaging the respective side edge of the central section of the other panel. A third panel is interengaged with said two panels in a similar manner so that an end section thereof engages an end section of the one panel and the external first edge of said end section of the third panel engages the corresponding external first edge of the second panel.

According to a second aspect of this invention, there is provided a method of building up a substantially planar array of a plurality of individual constructional panels each of which comprises a central section and two opposed end sections, the central section being of generally rectangular form with two parallel external side edges and two parallel end edges. Each end section has an isosceles trapezoid part conjoined to a rectangular part, the trapezoid part having parallel long and short edges and a pair of external oblique edges, and the rectangular part having a pair of parallel first edges and a pair of external second edges, the short edge of the trapezoid part conjoining an end edge of the central section and the long edge conjoining a first edge of the rectangular part, the other first edge of the rectangular part being external. The length of the external side edges of the central part are substantially twice the length of the each second edge of the rectangular parts. One of each side edge of the central section and each first edge of the rectangular part is provided with a projecting tab and the other of said side edge and said first edge is provided with a receptor of the projecting tab, which receptor includes a lock member releasably interengageable with a tab received in the receptor. Said method comprises:

bringing the second edge of one end section of a first panel into engagement with one side edge of the central section of a second panel, a second edge of an end section of the second panel simultaneously coming into engagement with a corresponding side edge of the central section of the first panel, said projecting tabs locating in the respective receptors of the first and second panels;

relatively moving the two panels to bring the adjacent oblique edges of the respective end sections into engagement and operating the respective lock members to lock together the first and second panels;

bringing the external first edge of an end section of a third panel into engagement with the first edge of the end section of the second panel already engaged with the first panel;

sliding relatively the engaged first edges of the second and third panels to bring the second edge of the end section of the third panel into engagement with the side edge of the central section of the first panel already engaged by the second panel, said projecting tabs locating in the respective receptors of the first and third panels; and operating the respective lock members to lock together the first and third panels, thereafter to restrain relative movement between all three panels.

The constructional panel of this invention has an overall external shape which is not a simple rectangle. Rather, the shape is somewhat complex but configured such that any one panel may be interconnected with a plurality of like panels, with no simple rectangular grid layout of lines of weakness between the interconnected panels. As such, the interconnected panels may form a particularly rigid array, allowing the panels to be used successfully to provide, for example, level ground decking despite some unevenness in the ground on which that decking is laid. Alternatively, the panel may be flexible, depending upon the intended use.

The complex shape (in plan) of this panel of this invention includes an isosceles trapezoid. Such a shape has two parallel sides of unequal length, and two further sides lying at the same angle (but in opposite senses) to each of those two parallel sides. In British-English, such a geometric figure is normally referred to as an isosceles trapezium, though the usual American-English term isosceles trapezoid is used herein.

BRIEF DESCRIPTION OF THE DRAWINGS

In order that the invention may better be understood, it will now be described in greater detail and one specific embodiment thereof given. This embodiment of constructional panel is intended for use as ground decking and is shown in the accompanying drawings, in which.

DESCRIPTION OF THE PREFERRED EMBODIMENTS

With the panel of this invention, it is preferred that at least some of the external edges of the panel are configured for direct connection to the corresponding edges of a second like panel. This may be achieved by providing on one of the edges which interengages the other edge one or more projections (such as a tab or an elongate tongue) and on that other edge corresponding one or more recesses for receiving the or each projection. Such interengaging projections and recesses may be provided on the respective oblique edges, as well as on the external first edges of the rectangular parts. Further, on the external side edges of the central sections as well as on the external second edges of the rectangular parts, there may be corresponding projections and recesses for those projections. In the case of these external side edges and external second edges, it is preferred for there to be projecting hooks which can be interengaged with corresponding lock members, which when operated serve to lock together two interengaged panels.

Preferably, the panel comprises a plastics material moulding, with an internal frame of metal or some other sufficiently strong material embedded with that moulding. In this case, the frame may provide projecting tabs and also receptors for the tabs of another like panel. Further, the internal frame may provide connection points for other components to be attached to the panel.

Though primarily intended for use as decking or other ground covering such as for hard-standing, a trackway or aircraft runway, the panels could be used for other constructional purposes, such as flooring, walling or cladding.

This invention extends to an array of panels each of this invention and interlinked so as to form an extensive area of the panels.

Figure 1:
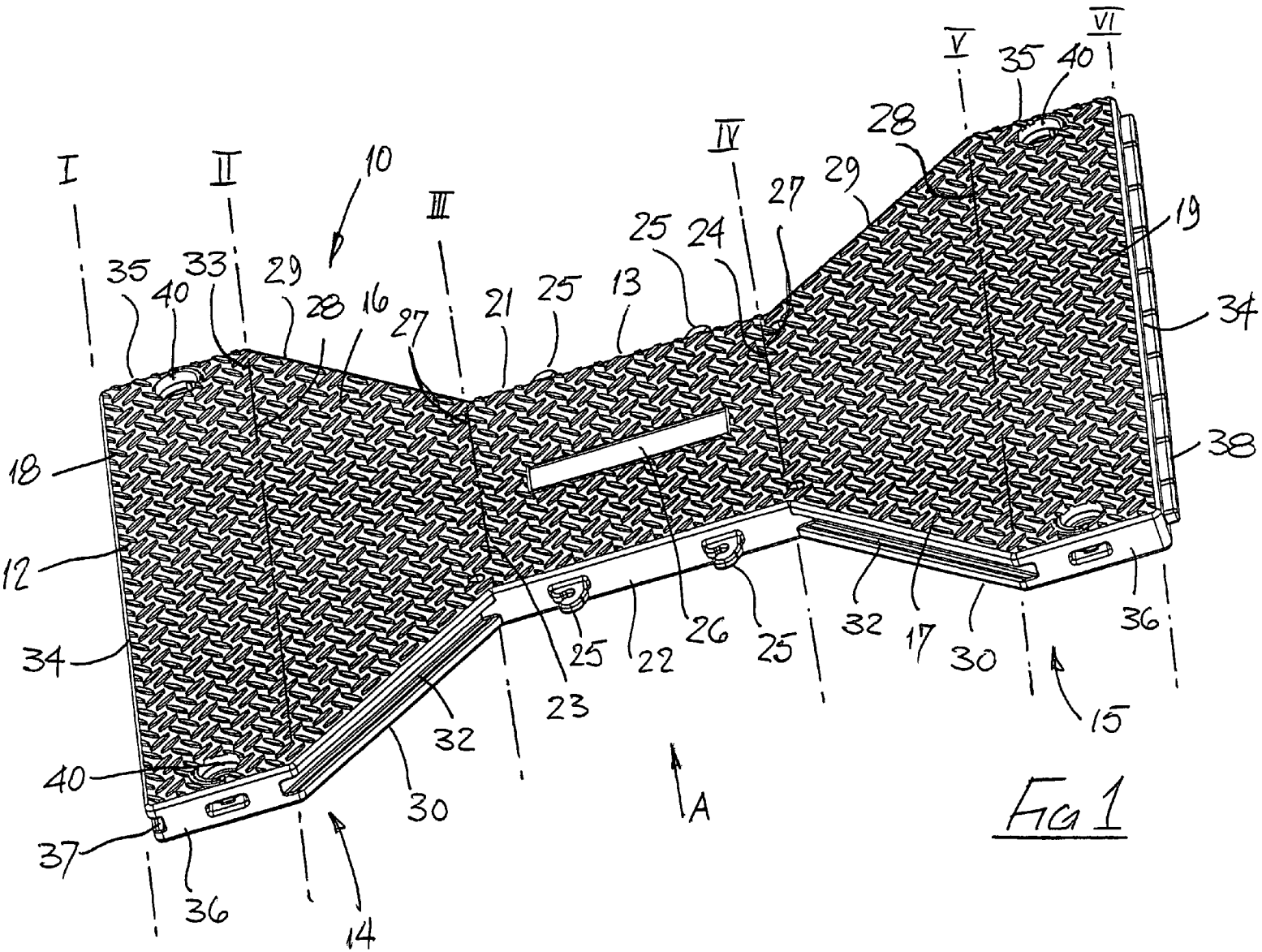
FIG. 1 is an isometric view of the embodiment of panel.

Referring now to the drawings, and FIG. 1 in particular, there is shown a ground decking panel 10 manufactured principally from a plastics material by a moulding operation, the panel having a metal reinforcing element 11 (FIG. 2) embedded therein, in order to impart sufficient strength to the panel for its intended use. The panel 10 has a patterned upper surface 12, to give the panel non-slip characteristics and various different patterns may be provided for this purpose. The panel is bound by several edges which are expressly configured to permit the panel to be connected to a plurality of like panels with the various edges interengaged and locked together. In order to form a continuous area of decking from an array of the panels, any one panel spaced from an edge of the continuous area will be interconnected with six like panels, as will be described hereinafter.

Conveniently, the panel may be divided into five notional sub-areas as shown by the long chain lines marked on FIG. 1. These areas are a central section 13, between chain lines III and IV, and two end sections 14 and 15, between chain lines I and III and IV and VI respectively. Each end section is divided into a respective isosceles trapezoid part 16 and 17, between chain lines II and III and IV and V respectively, and a rectangular part 18,19, between chain lines I and II and V and VI respectively. Each of these sections will now be described in more detail.

The central section 13 is of rectangular oblong form, though it could be square, and has a pair of external side edges 21,22 and a pair of end edges 23,24. Projecting laterally from the side edges 21,22 are hooks 25, formed integrally with the metal insert 11, to be described below. The hooks are oppositely directed on the two side edges, as best appreciated from FIG. 5. Centrally within the upper surface of the central section 13 is a plain rectangle 26, which may carry information as may be required, such as a maker's designation or type identifier, manufacturing information and so on.

Figure 3:
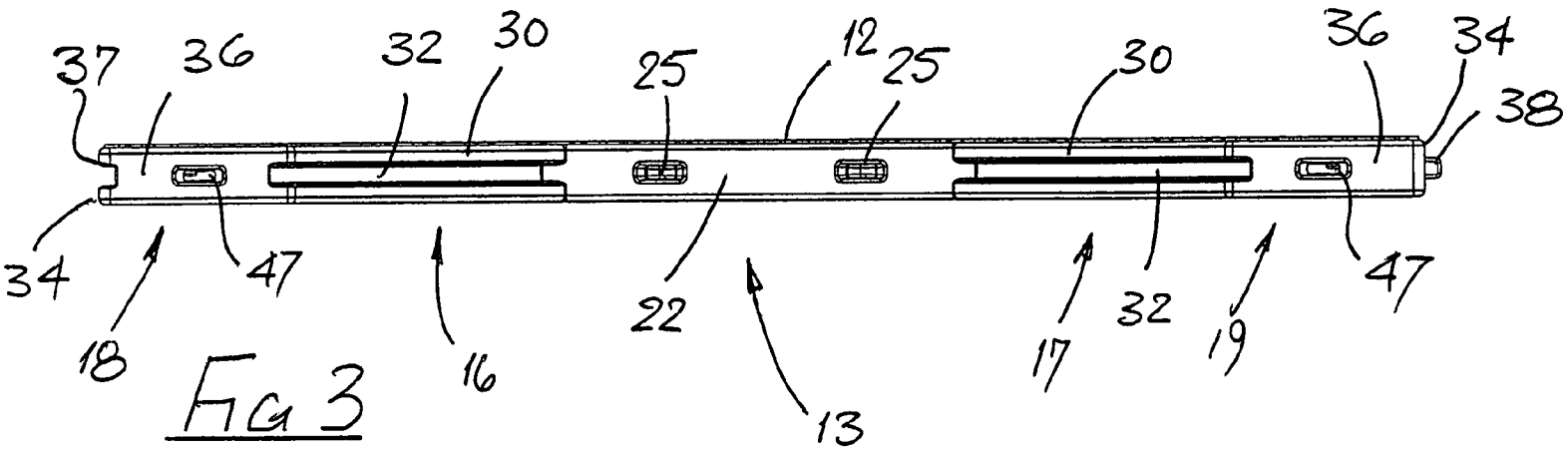
FIG. 3 is a side view on the panel of FIG. 1, in the direction of arrow A marked on that figure.

Each trapezoid part 16,17 has parallel short and long edges 27,28 and a pair of external oblique edges 29,30 disposed at the same angles (but in the opposite senses) to the respective parallel edges 27,28. The short edge 27 of each trapezoid part is in fact coincident with the respective end edge 23,24 of the central section. Both oblique edges 29 are formed with respective projecting tongues 31 (FIG. 5) and both oblique edges 30 are formed with respective grooves 32 (FIGS. 1 and 3), the tongues and grooves being configured for interengagement when two panels are fitted together.

Each rectangular part 18,19 has an internal first edge 33 which is coincident with long edge 28 of the respective rectangular part and an external first edge 34 parallel to internal first edge 33. Each rectangular part also has a pair of parallel external second edges 35,36, extending at right angles to the first edges 33,34. The external first edge 34 of one rectangular part is formed with a groove 37 (FIGS. 1 and 3) and the external first edge 34 of the other rectangular part is formed with a projecting tongue 38, the tongues and grooves being configured for interengagement when two panels are fitted together.

Figure 4:
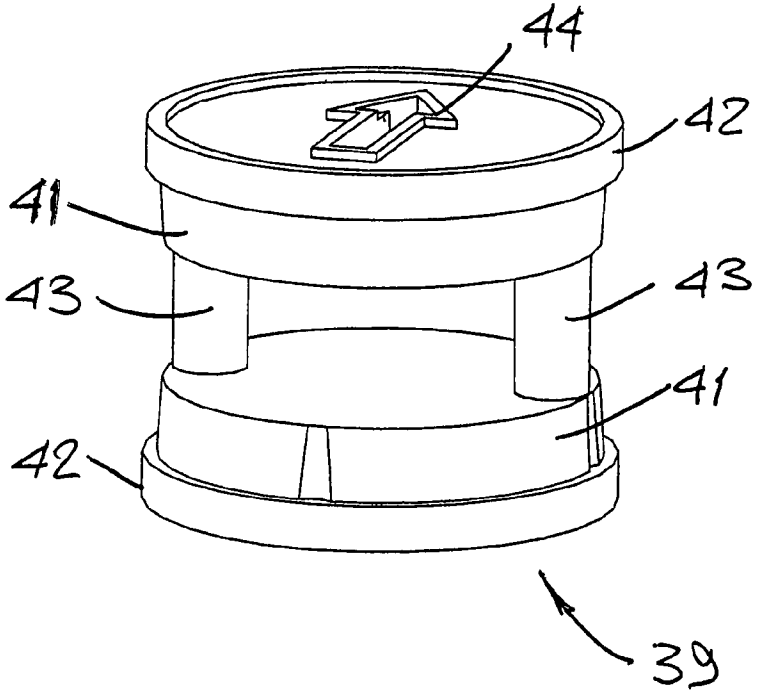
FIG. 4 is an isometric view on an enlarged scale of a lock member used in the panel.

Adjacent each second edge 35,36 of each rectangular part 18,19 is a respective rotatable lock member 39 (FIG. 4). Each lock member is located in a bore 40 formed through the thickness of the panel, the bore being counterbored from both sides. The lock member has a pair of discs 41 each having a flange 42 at its outer edge, and a pair of pillars 43 interconnects the discs to hold the them together, at the required spacing. The lock member 39 is manufactured in two parts which can be secured together; for example, each part may be similar so that the end of a pillar remote from one disc is received in a bore in the other disc. The end of the pillar may be a snap-fit in the bore, or may be secured by using an adhesive. As the two parts are moved into engagement from the two sides of the panel, the flanges 42 locate in the counter-bores such that the lock member cannot be removed, once the two parts have been secured together. The end faces of the discs are marked with an arrow 44, to indicate the position of the pillars 43 and so to facilitate the use of the lock member. The central region of the arrow is recessed, whereby a screwdriver blade may be inserted into the recess, for rotating the lock member.

Figure 2:
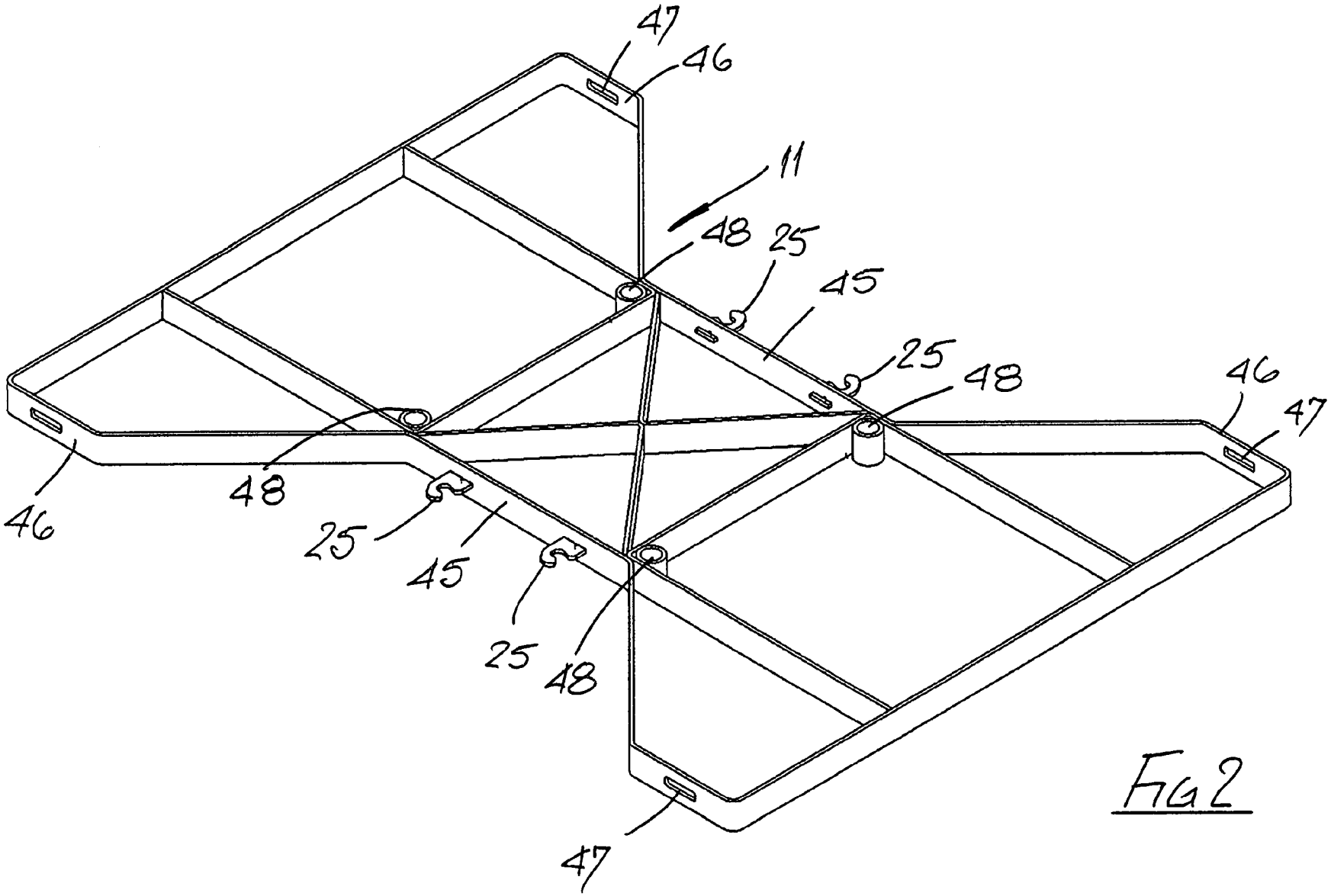
FIG. 2 is an isometric view of a metal insert, embedded within the panel of FIG. 1.

Referring now to FIG. 2, there is shown the metal insert 11 embedded within the panel, at the time of the moulding thereof. This example of an insert is pre-formed from metal strip, such as steel, in order to have the same shape as the panel when viewed in plan, but of a slightly smaller size such that the insert will lie adjacent the various edges of the panel, but will be covered with the plastics material to impart corrosion resistance to the insert. The insert is manufactured by welding together various strips pre-formed to have the required external shape, together with various reinforcing pieces internally within that shape. The parts 45 of the insert which will lie alongside the side edges 21,22 of the central section 13 carry the metal hooks 25 secured by a welding operation. The hooks on one side are oppositely directed compared to the hooks on the other side. Each further part 46, which will lie alongside a second edge 35,36 of the rectangular parts 18,19 has a slot 47 to permit the insertion therethrough of a hook 25 as the panels are fitted together. The locking members are disposed adjacent those slots 47, but internally of the insert, for interengagement with a hook inserted through the respective slot.

As shown in FIG. 2, the insert has four tubes 48 adjacent the corners of the central section 13 and arranged with their axes parallel and normal to the main area of the panel. These tubes may be used for the attachment of components to the panels, by drilling through the plastics material, or by blanking the plastics material from the tubes, during the moulding of a panel.

The insert may be made of other materials besides metal. For example, it might be moulded from a hard plastics material, or could be a carbon or glass fibre reinforced plastics moulding.

Figure 5:
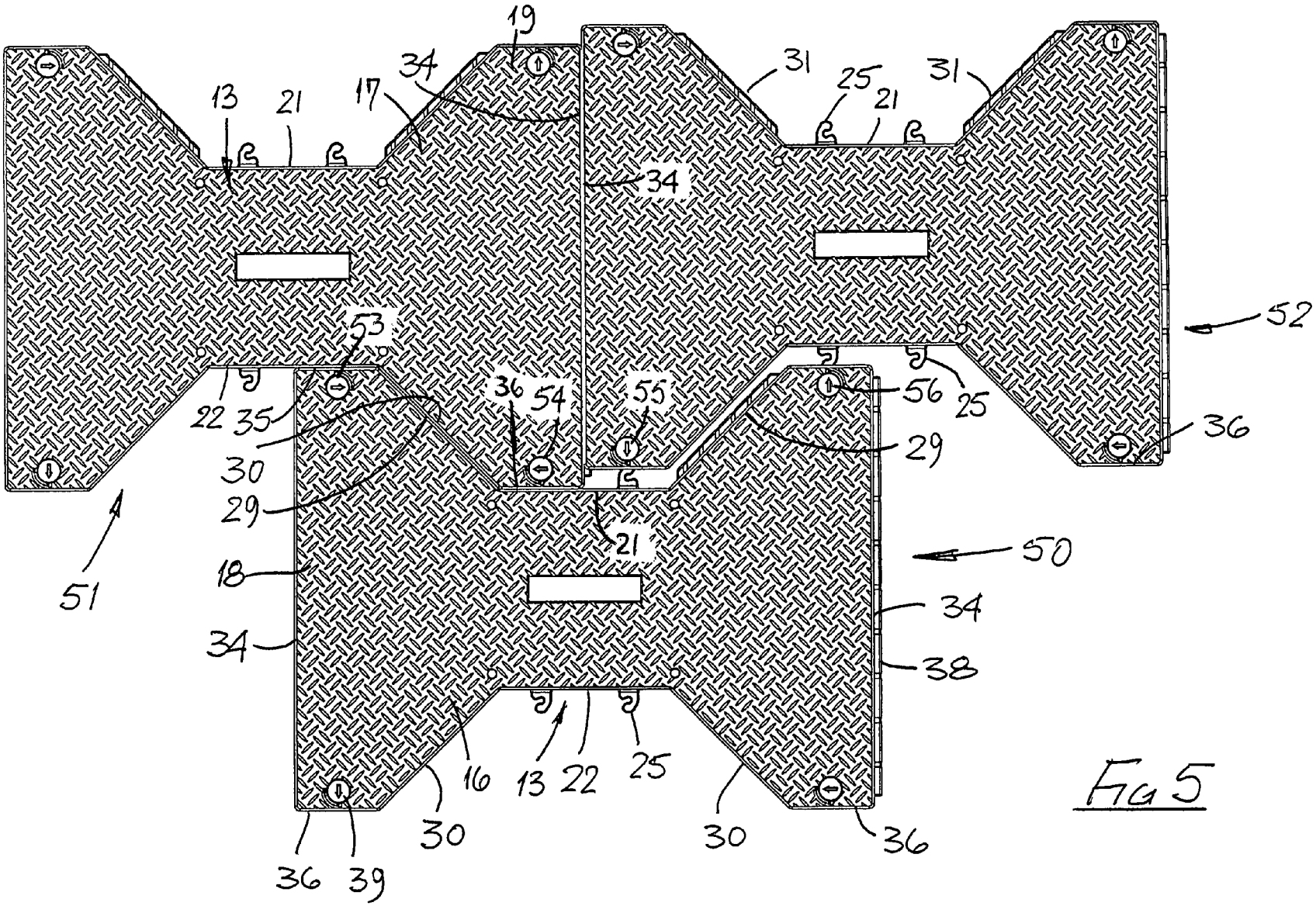
FIG. 5 shows three panels each as shown in FIG. 1, being interlocked together.

FIG. 5 shows the interconnection of three panels 50, 51 and 52, with the connection between panels 50 and 51 completed and panel 52 in the process of being connected to the other two. As shown, panel 51 is engaged with the left hand upper part (in FIG. 5) of panel 50, and the panel 52 is being engaged with the right hand upper part of that panel 50, as well as with the right hand external first edge 34 of panel 51.

Panel 51 has its second edge 36 of one rectangular part 19 lying alongside half of the length of a side edge 21 of the central section 13 of panel 50, one of the hooks 25 on that side edge 21 being received in the corresponding slot 47 of the second edge 36 of panel 51. The oblique edges 29,30 of the two interconnected trapezoid parts 16,17 of the two panels have their respective tongues and grooves 31,32 interengaged to prevent relative movement in a direction normal to the plane of the panels. Half of the side edge 22 of the central section 13 of panel 51 is engaged with the second edge 35 of the rectangular part 18 of the first panel 50, one of the hooks 25 on that side edge 22 of panel 51 being received in the corresponding slot 47 in the second edge 35 of panel 50. As shown, panels 50 and 51 are locked together by the lock members 53,54 being turned through 90°, so that the pillars 43 thereof engage the respective hooks 25 and so prevent subsequent separation of those panels 50,51.

Panel 52 has its left hand external first edge 34 engaged with the right hand external first edge 34 of panel 51, with the respective tongues and grooves fitted together. As such panel 52 is slidable with respect to panel 51, in the direction of the length of the engaged external first edges 34. From the position shown in FIG. 5, the panel 52 may be slid towards panel 50, to take up the position shown between panels 50 and 51, with the respective edges interengaging as described above. Then, the lock members 55,56 of the panels 51 and 52 are turned through 90°, to lock together panels 50 and 52.

Further panels may be fitted to the panels 50, 51 and 52 in the same manner, thus building up a complete array of like panels, all interlocked together. As will be appreciated, there will be no continuous straight line extending along the junctions between the panels. As such, there will be no line of weakness or flexibility, so giving the assembled array of panels high strength and rigidity.

The invention claimed is:

1. A constructional panel comprising a central section and two opposed end sections, said central section being of generally rectangular form with two parallel external side edges and two parallel end edges, each said end section having an isosceles trapezoid part conjoined to a rectangular part, said trapezoid part having parallel long and short edges and a pair of external oblique edges, and said rectangular part having a pair of parallel first edges and a pair of external second edges, the short edge of the trapezoid part conjoining an end edge of the central section and the long edge conjoining a first edge of the rectangular part, the other first edge of the rectangular part being external, and the length of the external side edges of the central part being substantially twice the length of the each second edge of the rectangular parts, whereby one said panel may be interengaged with other like panels by an oblique edge of an end section of said one panel being engageable with an oblique edge of an end section of a second panel, a second edge of the rectangular part of the interenchageable end sections of each of the two panels being engageable with the respective side edge of the central section of the other panel, and a third panel may be interengaged with said two panels in a similar manner whereby an end section thereof is engageable with an end section of said one panel and the external first edge of said end section of the third panel is engageable with the corresponding external first edge of said second panel, characterized by the feature that at least some of the external edges of the one panel are configured for connection to the corresponding edaes of the second like panel by providing on one of the edges which interengages the other edge, one or more projections, and on that other edge corresponding one or more recesses for receiving each projection.

2. A constructional panel as claimed in claim 1, wherein one oblique edge of each trapezoid part is provided with one or more projections and the opposed oblique edge of the trapezoid part is provided with a receptor for the or each projection on the oblique edge of a like panel.

3. A constructional panel as claimed in claim 2, wherein the or each projection is in the form of a tab projecting in a plane parallel to that of the panel.

4. A constructional panel as claimed in claim 2, wherein the projection is in the form of an elongate tongue projecting in a plane parallel to that of the panel, and the opposed oblique edge of the trapezoid part is provided with an elongate groove for receiving the tongue on the oblique edge of a like panel.

5. A constructional panel as claimed in claim 4, wherein the tongue and the groove both lie within the thickness of the panel.

6. A constructional panel as claimed in claim 1, wherein the external first edge of one end section of the panel is provided with at least one projection and the external first edge of the other end section of the panel is provided with a receptor for the or at least one projection on the external first edge of an end section of a like panel.

7. A constructional panel as claimed in claim 6, wherein the at least one projection is in the form of a tab projecting in a plane parallel to that of the panel.

8. A constructional panel as claimed in claim 6, wherein the at least one projection is in the form of an elongate tongue projecting in a plane parallel to the plane of the panel, and the external first edge of the other end section of the panel is provided with a groove for the tongue on the external first edge of an end section of a like panel.

9. A constructional panel as claimed in claim 8, wherein the second edges of the rectangular parts of the end sections are configured for interconnection with the side edges of the central section of a like panel.

10. A constructional panel as claimed in claim 9, wherein the second edges of the rectangular parts of the end sections are configured for releasable locking interconnection with the side edges of the central section of a like panel.

11. A constructional panel as claimed in claim 10, wherein one of each side edge of the central section and each first edge of the rectangular part is provided with a projecting tab and the other of said side edge and said first edge is provided with a receptor for said projecting tab, which receptor includes a lock member releasably interengageable with a tab received in the receptor.

12. A constructional panel as claimed in claim 11, wherein the projecting tab is hook-shaped.

13. A constructional panel as claimed in claim 12, wherein the lock member is rotatable between free and locked positions, the tab being insertable into and removable from the receptor when the lock member is in its free position and the tab when located in the receptor being held therein on turning the rotatable member to its locked position.

14. A constructional panel as claimed in claim 13, wherein each lock member is received in a respective bore extending through the panel, the lock member being rotatable with a suitable tool engaged with an end face of the lock member exposed in said bore.

15. A constructional panel as claimed in claim 14, wherein each lock member comprises a pair of spaced discs rotatably carried in said bore and a catch member extending between the discs which catch member is engageable with the projecting tab of another panel inserted into the receptor.

16. A constructional panel as claimed in any of claims 11, wherein each second edge of said rectangular parts of the end sections are provided with a respective locking member and each side edge of the central section is provided with a pair of projecting tabs for engagement with the locking members of two like panels.

17. A constructional panel as claimed in claim 1, and which panel comprises a plastics material moulding, there being an internal reinforcing frame embedded within the moulding.

18. A constructional panel as claimed in claim 11, and which comprises a plastics material moulding, there being an internal reinforcing frame embedded within the moulding, said frame providing the projecting tabs and also defining the receptors for the projecting tabs of another like panel.

19. A constructional panel as claimed in claim 18, wherein the reinforcing frame provides connection points for other components to be attached to the panel.

20. A method of building up a substantially planar array of a plurality of individual panels each of which comprises a central section and two opposed end sections, the central section being of generally rectangular form with two parallel external side edges and two parallel end edges, and each end section having an isosceles trapezoid part conjoined to a rectangular part, the trapezoid part having parallel long and short edges and a pair of external oblique edges, and the rectangular part having a pair of parallel first edges and a pair of external second edges, the short edge of the trapezoid part conjoining an end edge of the central section and the long edge conjoining a first edge of the rectangular part, the other first edge of the rectangular part being external, and the length of the external side edges of the central part being substantially twice the length of the each second edge of the rectangular parts, in which method:

the second edge of one end section of a first panel is brought into engagement with one side edge of the central section of a second panel, a second edge of an end section of the second panel simultaneously coming into engagement with a corresponding side edge of the central section of the first panel;

the two panels are moved relatively to bring the adjacent oblique edges of the respective end sections into engagement;

the external first edge of an end section of a third panel is brought into engagement with the first edge of the end section of the second panel already engaged with the first panel;

the engaged first edges of the second and third panels are slid relatively to bring the second edge of the end section of the third panel into engagement with the side edge of the central section of the first panel already engaged by the second panel; and the first panel is locked to the second and third panels thereafter to restrain relative movement therebetween.

21. A method of building up a substantially planar array of a plurality of individual panels each of which comprises a central section and two opposed end sections, the central section being of generally rectangular form with two parallel external side edges and two parallel end edges, and each end section having an isosceles trapezoid part conjoined to a rectangular part, the trapezoid part having parallel long and short edges and a pair of external oblique edges, and the rectangular part having a pair of parallel first edges and a pair of external second edges, the short edge of the trapezoid part conjoining an end edge of the central section and the long edge conjoining a first edge of the rectangular part, the other first edge of the rectangular part being external, and the length of the external side edges of the central part being substantially twice the length of the each second edge of the rectangular parts, and wherein one of each side edge of the central section and each first edge of the rectangular part is provided with a projecting tab and the other of the side edge and first edge is provided with a receptor of the projecting tab, which receptor includes a lock member releasably interengageable with a tab received in the receptor, in which method:

the second edge of one end section of a first panel is brought into engagement with one side edge of the central section of a second panel, a second edge of an end section of the second panel simultaneously coming into engagement with a corresponding side edge of the central section of the first panel, said projecting tabs locating in the respective receptors of the first and second panels;

the two panels are moved relatively to bring the adjacent oblique edges of the respective end sections into engagement and the respective lock members are operated to lock together the first and second panels;

the external first edge of an end section of a third panel is brought into engagement with the first edge of the end section of the second panel already engaged with the first panel;

the engaged first edges of the second and third panels are slid relatively to bring the second edge of the end section of the third panel into engagement with the side edge of the central section of the first panel already engaged by the second panel, said projecting tabs locating in the respective receptors of the first and third panels; and the respective lock members are operated to lock together the first and third panels thereafter to restrain relative movement between all three panels.

22. A method of building up a substantially planar array of a plurality of individual panels each of which comprises a central section and two opposed end sections, the central section being of generally rectangular form with two parallel external side edges and two parallel end edges, and each end section having an isosceles trapezoid part conjoined to a rectangular part, the trapezoid part having parallel long and short edges and a pair of external oblique edges, and the rectangular part having a pair of parallel first edges and a pair of external second edges, the short edge of the trapezoid part conjoining an end edge of the central section and the long edge conjoining a first edge of the rectangular part, the other first edge of the rectangular part being external, and the length of the external side edges of the central part being substantially twice the length of the each second edge of the rectangular parts, and wherein one of each side edge of the central section and each first edge of the rectangular part is provided with a projecting tab and the other of the side edge and first edge is provided with a receptor of the projecting tab, which receptor includes a lock member releasably interengageable with a tab received in the receptor, in which method:

the second edge of one end section of a first panel is brought into engagement with one side edge of the central section of a second panel, a second edge of an end section of the second panel simultaneously coming into engagement with a corresponding side edge of the central section of the first panel, said projecting tabs locating in the respective receptors of the first and second panels;

the two panels are moved relatively to bring the adjacent oblique edges of the respective end sections into engagement; the external first edge of an end section of a third panel is brought into engagement with the first edge of the end section of the second panel already engaged with the first panel;

the engaged first edges of the second and third panels are slid relatively to bring the second edge of the end section of the third panel into engagement with the side edge of the central section of the first panel already engaged by the second panel, said projecting tabs locating in the respective receptors of the first and third panels; and the respective lock members are operated to lock together the first, second and third panels thereafter to restrain relative movement between all three panels.

* * * * *